United States Patent [19]

Williams et al.

[11] 3,942,349

[45] Mar. 9, 1976

[54] CROWN DIE FOR THREAD ROLLING OF APPLICATOR ROLLS

[75] Inventors: Edward George Williams, Macedon; Richard George LaBombard, Henrietta, both of N.Y.

[73] Assignee: Xerox Corporation, Stamford, Conn.

[22] Filed: Dec. 30, 1974

[21] Appl. No.: 537,156

[52] U.S. Cl. ..... 72/98; 72/118; 72/103

[51] Int. Cl.[2] ..... B21H 3/04

[58] Field of Search ..... 72/103, 104, 118, 98

[56] References Cited

UNITED STATES PATENTS

| | | | |
|---|---|---|---|
| 2,645,954 | 7/1953 | Pfingston | 72/118 |
| 2,937,547 | 5/1960 | Moeltzner | 72/104 |
| 3,651,678 | 3/1972 | Zook, et al. | 72/103 |

*Primary Examiner*—Lowell A. Larson

[57] ABSTRACT

A die for through feed thread rolling of fine external threads on a cylindrical work piece or applicator roll is given whereby a die having substantially uniform threads and a variable diameter is employed.

5 Claims, 2 Drawing Figures

CROWN DIE FOR THREAD ROLLING OF APPLICATOR ROLLS

Figure 1:
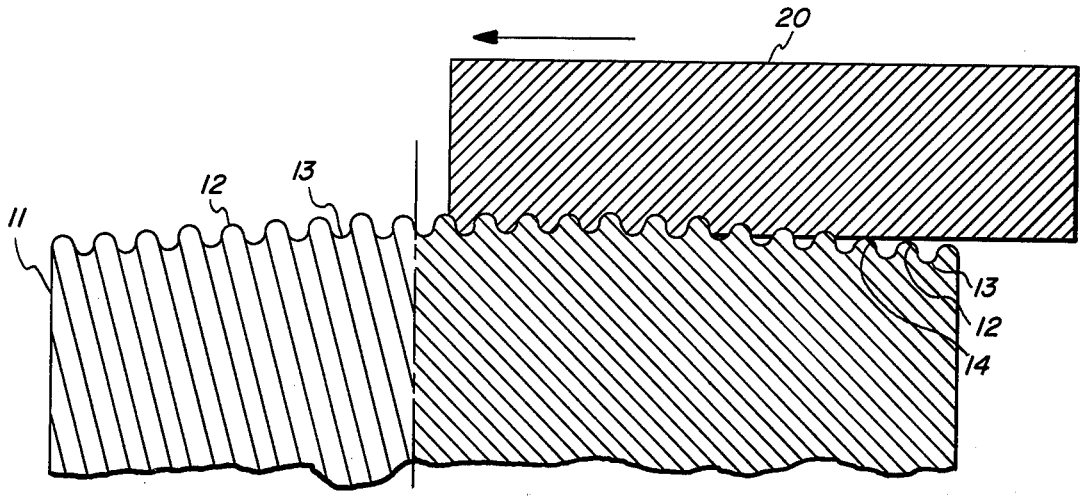

This invention relates to the production of threaded surfaces. Specifically, this invention relates to the manufacture of fine pitched, high quality, threaded surfaces having utility on applicator rolls as well as other conventional uses. More particularly, this invention pertains to tools for rolling threads on work pieces as they pass between or through one or a cluster of such tools, usually two or three, which are rotated in unison to produce surface metal flow on the work piece to form a continuous thread configuration.

In electrostatic recording as typified by xerography, it is usual to form an electrostatic latent image on an insulating or photoconductive insulating surface, generally conforming to information to be recorded or reproduced. This image may then be developed or made visible by the application of an electrostatically attractable material which deposits in conformity with the electrostatic latent image to produce a visible record. In the usual embodiments of electrostatographic development, it is conventional to employ finely divided insulating materials, generally powders, which are presented to the image bearing surface in particulate form. Thus, conventionally, the electrostatic latent image is generally developed by cascading across the image surface a mixture of relatively large carrier beads or granules bearing on their surfaces finely divided pigmented toner particles. Alternatively, insulating or conductive toner or liquid developers have been presented to the image in an air suspension. Likewise, toner may be carried on the surface of a brush or brushlike fiber such as a fur brush or a simulated brush of magnetically adhering particles.

U.S. Pat. No. 3,084,043 issued to Robert W. Gundlach discloses that an electrostatic latent image may be developed or made visible by presenting to the image surface a liquid or ink-type developer on the surface of a suitable developer dispensing member such a developer dispensing member comprises a support base having disposed on its surface a raised pattern which may comprise a plurality of fine raised lines, dots, or other raised material. The patterned material on the developer dispersing surface is generally a very finely divided pattern, regular in configuration or at least in pattern size, and adapted to maintain spacing between a developer dispensing surface and a developer receiving surface sufficient to keep the developer out of contact with the recording surface in the background areas. The developer dispensing member is prepared by the use of a process in which the liquid developer is supplied to fill the roots or valleys between the crests, lands, or dots of the pattern. This may be accomplished, for example, by wiping the surface with a thoroughly wetted cloth or by means of rolls or the like, preferably followed by squeegeeing off the excess developer. When prepared in this manner, the developing dispensing member bears on its surface substantially uniform film of developer punctured by the dots or other raised pattern in such a manner that a smooth surface pressed in contact with the developer dispensing member is in contact only with the peaks of the pattern and not with the developer film. Desirably, sufficient developer should be placed on and allowed to remain on the surface of the developer dispensing member so that this member may be placed against a sheet of paper or other relatively smooth surface without transferring quantities of developer to such surface. For image development, the surface of the developer dispensing member is pressed either simultaneously or progressively into contact with the area in which a pattern is to be developed on the image bearing surface causing developer transfer to the image surface in conformity with the electrostatic image.

The working surface of a roll for application of a liquid developer to an electrostatically charged photoreceptive surface is composed, for example, of a multihelicoid thread pattern having from about 150 to about 350 threads per inch at about 45 degrees right or left hand lead. Other angles may be used such as from about 20 degrees to 80 degrees from axis. The thread configuration is typically about 0.0050 inch pitch, about 0.001 inch top land, and with about 35 to 65 micron depth. The overall roll size may be typically about 1 inch in diameter and approximately 9 inches in length, exclusive of journals. Typically, such a roll may be made from aluminum, brass, zinc, carbon steels, and alloys thereof.

The manufacture of such rolls is difficult owing to the high manufacturing standards required.

Such rolls may be fabricated by mechanical engraving, but this well known technique is very time consuming. On the other hand, conventional rolling which as a method of fabrication differs from engraving primarily in that in rolling, the roll to be grooved is supported by a backing roll instead of on bearings, and is fast and efficient. Unfortunately, high quality, fine threaded rolls are not generally available from conventional rolling techniques.

It is conventional practice to have an entry section on thread rolling dies such that there is provided a converging opening between the dies that permits the work readily to enter therein. The rolling thread producing surfaces of the dies thus contact the work piece to initiate metal flow at the surface of the work piece that will raise portions corresponding to the crests of the finished thread on the work piece and correspondingly depress portions of the work piece corresponding to the roots of the finished thread. One conventional practice provides a starting section having a fully formed thread. This arrangement, namely, the initial entry of the sharp edge of the die tooth followed by subsequent edge penetration of the same tooth gives rise to a finished thread formation in the work in which there appears a fine continuous crevice extending the length of the finished thread. This crevice is generally undesirable. A second problem generally found in prior art dies is that the threads are often improperly formed or damaged in the initial starting section, which generally necessitates a second machining step. Another disadvantage of some of the prior art dies is that uniform straight profiles on fine pitched surfaces is not generally found.

Various techniques have been suggested for improving thread rolling operations such as those described in U.S. Pat. No. 2,720,801 in which a set of dies are inclined to the axis of the work and provided with a root and crest contour to make full contact with the threads formed in the work. This patent suggests maintaining a constant root diameter for the thread rolling die in conjunction with a tapered run-on section in which there are rounded crests on the initial thread turns. U.S. Pat. No. 2,828,493 shows a tap including a roller die for producing an internal thread in which the metal is compressed rather than redistributed. U.S. Pat. No. 3,131,407 shows a thread swaging tap which slides with respect to the internal threads which are progressively developed by compressing the metal in the wall of the hole. Finally, U.S. Pat. No. 3,651,678 a tap having flat surface crests is shown which forms a predetermined angle with the axis of the roll and tapers to a diameter at the starting end less than the mean heights of the fully formed threads.

It is an object of this invention to provide for a through feed thread rolling die which gives different and in fine thread rolling proved products. It is a further object of this invention to provide for a thread rolling die which can operate by itself or in a cluster, skewed with respect to the centerline of the work piece which will permit straightness of thread, improved metal deformation, and structurally sound threads. Other objects and advantages will become apparent from a reading of the ensuing specification.

In the present invention, a thread rolling die is adapted to be rotatably supported by itself or in a cluster exteriorly to a cylindrical work piece with the roll axis skewed from the axis of the work piece. The die has an overall crown-type structure. This unique structure can be characterized as being similar to the arc of a segmented circle. Typically, the die has a variable root and crest diameter which is larger in size at some intermediate point from the ends, preferably at the center of the die, and smaller at the die edges with a substantially uniform transition between the two limits. This structure substantially eliminates misalignment problems and assists in developing a smooth subsurface flow of metal. As the diameter of the pointed crests on the die increases towards the highest level of the crown, a metal deformation is produced which gives a fully formed, structurally sound threads having a substantially uniform, straight profile, and being free from significant imperfections. The crest of the developing thread on the work piece flows uniformly into the root of the die thread to produce a fully formed thread which has a crest that completely fills the root of the die and has a structural integrity of solid metal in contrast to the prior art formation of opposing folds with a crevice remaining therebetween.

This unique flow properties and other advantages of this invention are accomplished in the preferred form of the invention by a die having a variable root diameter and a variable crest diameter on the outer surface of the die roll, both of which are substantially uniform with respect to each other, where both variable diameters of the die may be characterized as corresponding to the arc of a segmented circle.

In a second embodiment of the invention, the die is of like structure to that described above, but modified such that the die is cut along its axis at the point where the diameter of the crown is greatest. For reasons that will be discussed later such a structure can be used in an identical fashion to the first embodiment with the same useful and advantageous results.

Figure 2:
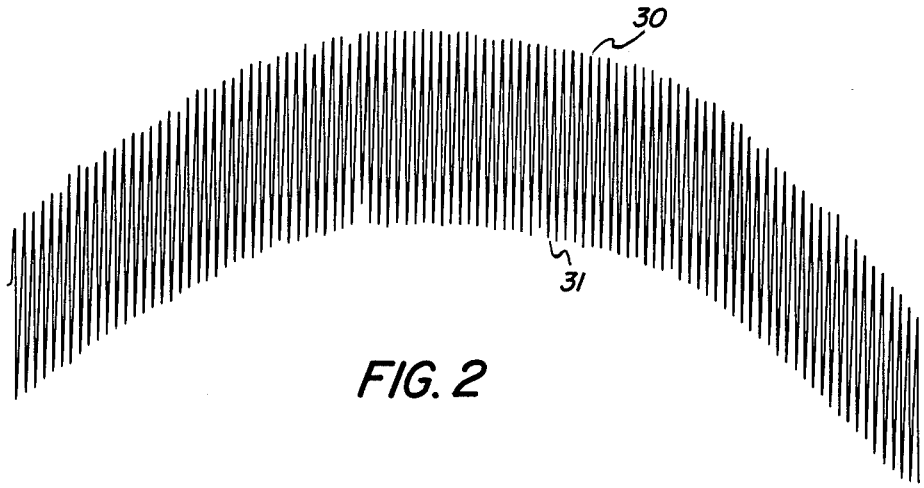

The invention will be further described with to the drawings where:

FIG. 1 is a view partly in section of a thread rolling die having a helical thread made in accordance with the invention shown in relation to an incoming cylindrical work piece; and FIG. 2 is a profile trace of the typical die employing the features of the invention.

Referring to FIG. 1, a thread rolling die generally indicated as 11 is shown in the form of a roll with an external helical thread formed thereon. The die 11 may be any desired diameter and is adapted to be driven by itself or in a cluster of such dies spaced to form a centerline between the dies which is correct for the size of the work to be externally threaded. In this embodiment of the invention, a single thread is developed on the surface of the die 11 consisting of a plurality of turns in the form of a continuous helix. Depending upon the diameter of the dies in relation to the work, multiple helical thread configurations may also be employed. For simplicity of illustration however, the invention is illustrated with respect to a single continuous helical thread on the roll with the understanding that the invention can be applied to multiple helical thread configurations as well.

The die of FIG. 1 is shown with the surface sectioned. Crests 12 and 12' and roots 13 and 13' are the same continuous surface respectively. The profile across the crest surfaces can be seen to be rounded or in the form of an arc of a circle. In like fashion, a profile of the roots is seen to be rounded or in the form of an arc. As shown, the crests and roots respectively, have a variable diameter which is larger in size at the approximate center of the die and smaller at the two edges with a substantially uniform transition between the two limits. In the manufacture of extremely fine threads, the difference between the heights of the highest crest and the lowest crest may conveniently range from between about 0.0025 and about 0.050 inch. Generally speaking, the lateral distance between these two limits, the larger and smaller crests, should be about at least 0.12 inch. If the working surface of the die is considered to be in the form of an arc of a segmented circle, the initial angle between the chord and the arc should be greater than about ¼ of one degree. Also shown in FIG. 1 is a portion of a cylindrical work piece 20 which is progressing through die 11 with rolling forces applied radially inwardly by a backing roll (not shown) in balanced relation to the work piece such that the desired external thread formation is rolled into the metal surface of the work piece. It will be understood that the rolling operation may take place with the die 11 and the other identical dies (not shown) each rotating about a central axis, which may or may not be parallel to the direction of motion of the work piece 20 indicated by the arrow in FIG. 1. The roll axis about which the roll rotates is also taken as the axis of reference for the angles of the various portions of the helical thread on the surface of the die 11.

The work piece contacts the die at some initial crest, here shown as 14, which is a full size thread and which corresponds in size and pitch to the desired finished thread formation for the work 20. Because of the arc structure or angle between the die 11 and initial entry point of work piece 20, the work piece gradually enters the die and the metal flow which forms the thread is gradually initiated. As the work piece is gradually engaged, the subsequent crests penetrate deeper into the work piece causing a uniform metal flow which progresses into the roots of the die without a tendency to produce a crevice in the developing thread structure on the work piece 20. The metal flows steadily toward the root of the die thread as the crest moves into the work. At the point of the die where the crests are of largest diameter, the work is finished in the known and conventional manner with the final desired size and tolerance dimension of the threaded work piece being that identical to the die at that point. As the work piece continues to move through the die, the subsequent die crests drop below the threaded work piece permitting it to exit from the free end of the die.

When a cluster of dies is employed, the angle of the arc structure or taper is such that the entry end of the die has a diameter which, when mounted in a cluster, provides an entrance of greater diameter than the diameter of the cylindrical work piece 20 as it enters the die. Thus, the crests contact the work piece at some intermediate point suggested at 14 on the entry surface and as contact is made, the internal metal flow in the work 20 is initiated.

Referring to FIG. 2, the details of the threaded surface of a die of this invention are shown. By employing a surface or profile trace such as could be obtained by using a Gould Surfanalyzer Model 1200, the unique features of this invention can be more easily seen. In using such a device, a stylus travels across the surface of the die transmitting a signal to a recorder which diagrammatically reproduces the profile. Here in FIG. 2, approximately ½ inch of width or face of a typical die of this invention is shown in the profile trace. The horizontal magnification is 10X and the vertical magnification is 500X. The upper crests 30 and the lower roots 31 are seen to be substantially even in transition between the lesser and the greater diameters following the general curve of an arc. The distance between the crests and their neighboring roots are seen to approximately equal and equivalent to the depth of the desired thread to be formed. The spacing between adjacent crests and adjacent roots are likewise substantially equal and are equivalent to the thread separation desired. In an embodiment of this invention, threads produced by a die similar to that profiled in FIG. 2 where the measurements are made normal to the thread helix angle will have adjacent crests 0.0054 inch apart, thread depth of 0.0025 inch and a groove or thread angle, that is the angle of the thread walls adjacent to a root of between about 50° and 60°. The helix of this die was 67½°.

In a modified form of the invention, the die may be cut or ended at the high point of the crests and roots thus having a truncated section at the point where the work piece is finished. Otherwise, the die is identical to that described in FIG. 1.

The tool or die of this invention may be manufactured by any acceptable technique. One useful way is by mechanical engraving where a working tool is moved along the surface of a die blank to form the desired profile.

Dies heretofore described carry out a novel method in the formation of exterior threads on a cylindrical work piece. The helical thread on the die initially engages the cylindrical work piece at the point where the crest diameter is small and moves toward the slightly rising surface. As the die and the work rotate, the applied force enters into the work piece to a greater depth to form the thread. The metal is displaced both laterally and generally outwardly beyond the original diameter of the work piece. The depth of entry of the tool into the work piece terminates when the crest of the largest diameter is encountered. The metal of the work piece that is displaced is displaced at a decreasing rate and that part moving outwardly enters into a helical space in the tool beyond the original circumference of the work piece, which space has a greater circumference than the circumference of the space from which the metal has been displaced by the tool. Thus, the metal entering into the exterior area provided by the tool beyond the original surface of the work piece enters into a space of greater volume than that from which it was displaced. Hence, the metal forming the outer half of thread beyond the pitch line may be of slightly less density than the base portion of the thread adjacent the root. From the foregoing, it will be understood that the tool performs a method in which the threads are created by displacement of metal at a diminishing rate and with that part of the thread beyond the pitch line being of no greater density than the density of the root portions of the thread. Thus, this method is distinguished from many techniques relation to the rolling of threads in which the threads are created by compression of the metal.

The following example further defines, describes, and demonstrates a method of utilizing the process of this invention to fabricate rolls.

EXAMPLE I

A blank roll of 1040 normalized steel about one inch in diameter and about nine inches long with the diameter held within a total tolerance of about 0.0005 inch is inserted in a machine such as available from Reed Rolled Thread Die Company, Holden, Massachusetts, Model B-112. The machine is a directly opposing two die straight thru or on center thread rolling machine with a capacity of part size from about ⅛ inch to about 2½ inches in diameter and up to about 24 inches in length when supported on centers, and up to about 20 feet in length on thru feed. One of the machine dies is removed and replaced with a cast nylon backing roll which is about 5.4 inches in diameter and about 3 inches in length. The nylon backing roll has a hardness of about Rockwell R116 hardness and is mounted on a spindle. The cast nylon backing roll drive is disengaged. A crown die of this invention about 6 inches in diameter and about 0.75 inch in length made of hard steel to produce about a 67½° lead angle helix patterned roll containing about 180 threads per inch is mounted on a spindle on the other machine head. The crown is approximately 0.003 inch high in the center of the die face. The steel blank work roll is mounted on centers in the machine and held by hydraulic pressure. The nylon backing roll is brought into place to engage the steel blank work roll. The machine's centers are free floating, within limits, in a centering device so that the work roll is always centered between the die and the backing roll during the rolling process. The machine is started at a die speed of about 100 rpm and as the die rotates it pulls the blank roll forward in the centering device. When the die and backing roll initially engage the blank roll and the thread rolling starts there is substantially no slippage as is commonly found. With very fine and shallow thread rolling, there is normally a tendency for the few initial threads to tear. However, this does not occur in the method of this invention using the crown die. As the threads are rolled in the blank roll they become the gripping surface pulling the part forward. When the part is completely rolled, the machine stops and the die and the backing roll retract. The centering device pressure is released and the fabricated part is removed from the machine. About 1 minute is required to groove the blank roll from the time the machine is started. The average thread depth of the grooved roll is about 50 microns.

To determine the quality of the roll fabricated, the grooved surface is cleaned with a solvent to remove any contaminents such as grease and oil. The roll is mounted in a machine suitable for electrostatographic polar liquid development and positioned in contact with a photoreceptor surface. The photoreceptor surface is electrostatically charged uniformly by means of corona discharge and subjected to imagewise exposure of a light and shadow pattern to form an electrostatic latent image thereon. The latent image is developed with a liquid developer contained in a trough which is applied to the roll by a feed roller. Excess liquid from the roll surface is carefully wiped away at every cycle by a doctoring device. The clean tips of the ridges on the roll provide a finite spacing between the photoconductor and the liquid. The liquid is retained in the grooves of the roll and out of mechanical contact with the photoconductive surface. Development by electrostatic attraction takes place on the photoconductor surface in those areas of the photoconductor containing an electrical charge by the liquid creeping up the sides of the roll cell walls into contact with the photoconductor. In those areas of the photoconductor which are not electrostatically charged, the liquid remains in the roll cell walls out of contact with the photoreceptor. The printing speed is about ten inches per second. The printed copy produced by the rolled steel roll is in general equal to and in some cases superior to that produced by a mechanically engraved carbon steel roll having substantially the same pattern as the rolled roll and employed as a control. Less background is obtained by the roll produced by this invention.

While this invention has been particularly described with reference to specific embodiments, the invention is not so narrow and should be viewed only in the light of the appended claims.

What is claimed is:

1. A thru feed thread rolling die for producing metal flow on the exterior surface of a cylindrical metal work piece to form a continuous, substantially straight uniform thread configuration free of a crevice along the thread crest, comprising a roll formed with a substantially uniform external thread having a variable diameter profile corresponding to the arc of a segmented circle.

2. A thru feed thread rolling die for producing metal flow on the exterior surface of a cylindrical work piece to form a continuous, substantially uniform thread configuration comprising a roll formed with a substantially uniform external thread having a substantially uniform depth and having a variable crest diameter profile which is greater at some point intermediate of the die ends and smaller at the die ends with a substantially uniform transition between the greater diameter and smaller diameter.

3. The die of claim 2 wherein the diameter of the largest crest is between about 0.0025 and 0.05 inch greater than the diameter of the smallest crest.

4. The die of claim 2 wherein the transition between the greater diameter and the smaller diameter is in the profile of and arc of a segmented circle.

5. The die of claim 4 wherein the angle between the chord of the arc and the crest profile is greater than about ¼ of one degree.

* * * * *